United States Patent [19]

Merola et al.

[11] 4,033,738

[45] July 5, 1977

[54] HEAT PUMP SYSTEM WITH MULTI-STAGE CENTRIFUGAL COMPRESSORS

[75] Inventors: Carl R. Merola, Monroeville Borough; William F. Evans, Penn Township, Westmoreland County; Raymond E. Shaffer, Hempfield Township, Westmoreland County, all of Pa.

[73] Assignee: Westinghouse Electric Corporation, Pittsburgh, Pa.

[22] Filed: Mar. 12, 1976

[21] Appl. No.: 666,277

[52] U.S. Cl. ..... 62/158; 62/196 A

[51] Int. Cl.[2] ..... G05D 23/32

[58] Field of Search ..... 62/510, 196 A, 158, 62/231, 175

[56] References Cited

UNITED STATES PATENTS

| | | | |
|---|---|---|---|
| 2,177,602 | 10/1939 | Spann | 62/158 |
| 2,196,687 | 4/1940 | Steinfeld | 62/180 |
| 3,599,006 | 8/1971 | Harris | 62/158 |
| 3,668,883 | 6/1972 | Ruff et al. | 62/158 |

OTHER PUBLICATIONS

PF Centrifugal Chiller Electrical System, pp. 24–33.

*Primary Examiner*—William E. Wayner
*Assistant Examiner*—Robert J. Charvat
*Attorney, Agent, or Firm*—E. C. Arenz

[57] ABSTRACT

The heat pump system includes a first and a second centrifugal compressor arranged in series relation in a system including interstage expansion of the refrigerant. A pair of parallel circuits is provided for controlling the energization of the compressors in a sequence in which the first to start compressor must be energized to obtain completion of the second parallel circuit required for energization of the second to start compressor. The start of the second compressor is delayed for a period permitting the first compressor to come up to speed and the first circuit controlling the energization of the first compressor will be interrupted unless the second compressor has started within a short period of time after the time delay in starting the second compressor.

The arrangement also includes a thermostatic switch in the first circuit and a relay arrangement controlled in accordance with the thermostatic switch for opening a part of the second circuit in accordance with the opening of the first circuit with the thermostatic switch. With this arrangement, a third, manual-reset circuit which must remain in a completed condition for normal operation of the compressors in accordance with temperature demands, is prevented from being interrupted by operation of a time delay opened switch in the manual-reset circuit under the control of a safety timing means in a branch circuit of the second circuit.

8 Claims, 3 Drawing Figures

HEAT PUMP SYSTEM WITH MULTI-STAGE CENTRIFUGAL COMPRESSORS

BACKGROUND OF THE INVENTION

The invention pertains to the art of heat pump systems in which staged compressors are used in a series arrangement and in which under normal operating conditions both of the compressors run when the system is operating. Since both compressors are started with across-the-line starters and it is therefore undesirable to start them both at once, the control of the invention is directed to an arrangement in which the sequential starting of the two compressors is obtained within a few seconds but with neither compressor continuing to operate if the other, for some reason, fails to start and run.

It is of course known to provide heat pump systems and refrigeration systems with multiple compressors and to arrange them so that, to the extent more than one will operate, they are brought onto the line in sequence. However, so far as we know these arrangements are typically of the type in which a second or third compressor is brought onto the line only when needed so that there is no requirement that the second or third compressor be brought onto the line for the first compressor to continue to operate. In some of these patents, such as U.S. Pat. Nos. 2,434,221 and 2,453,095 the second compressors are brought on line in accordance with pressure conditions in the refrigeration system and without the provision for time delays or a requirement that both compressors operate if either is to operate.

U.S. Pat. No. 3,599,006 discloses a control arrangement for a cascade refrigeration system in which three compressors are brought onto the line in sequence, separated by about 10 seconds each, but without an arrangement for making their operation interdependent upon each other as is provided in our invention.

U.S. Pat. No. 3,668,883 also discloses multiple compressors but again the control arrangement is such that the main compressor is capable of operating alone and the booster compressor is only brought on line as needed.

The aim of our invention is to provide a heat pump system with series arranged compressors and a control arrangement which provides for starting of the compressors in close sequence with the shutdown of the system if either compressor should fail to start and run.

SUMMARY OF THE INVENTION

In accordance with the invention, a first and second refrigerant compressor are arranged for series refrigerant flow and for operation together when either of the compressors operates. A control circuit arrangement provided includes a pair of parallel circuits for controlling the energization of the compressors, the first of the circuits including a first control relay required to be energized to start the first of the compressors and the second of the circuits including a second control relay required to be energized to start the second of the compressors. The circuits are electrically interconnected to make the energization of said second control relay dependent upon the energization of said first control relay and the elapse of a short time period following the energization of said first control relay, and to make the continued energization of said first control relay beyond a time period slightly longer than said short time period, following initial energization of said first control relay, dependent upon the energization of said second control relay before the elapse of said slightly longer time period.

Additionally, the first circuit includes thermostatically-operated switch means and the second circuit includes a switch operating in slave relation thereto so that the control of the first and second circuits is concurrent with respect to operation in accordance with temperature demands. With this arrangement, a timing means in a branch of the second circuit is prevented from time opening a switch in a third, parallel, manual-reset circuit which is required to be in a completed condition to permit the energization of the compressors under normal temperature cycling conditions calling for the compressors to be energized and deenergized in accordance therewith.

DRAWING DESCRIPTION

DESCRIPTION OF THE PREFERRED EMBODIMENT

Figure 1:
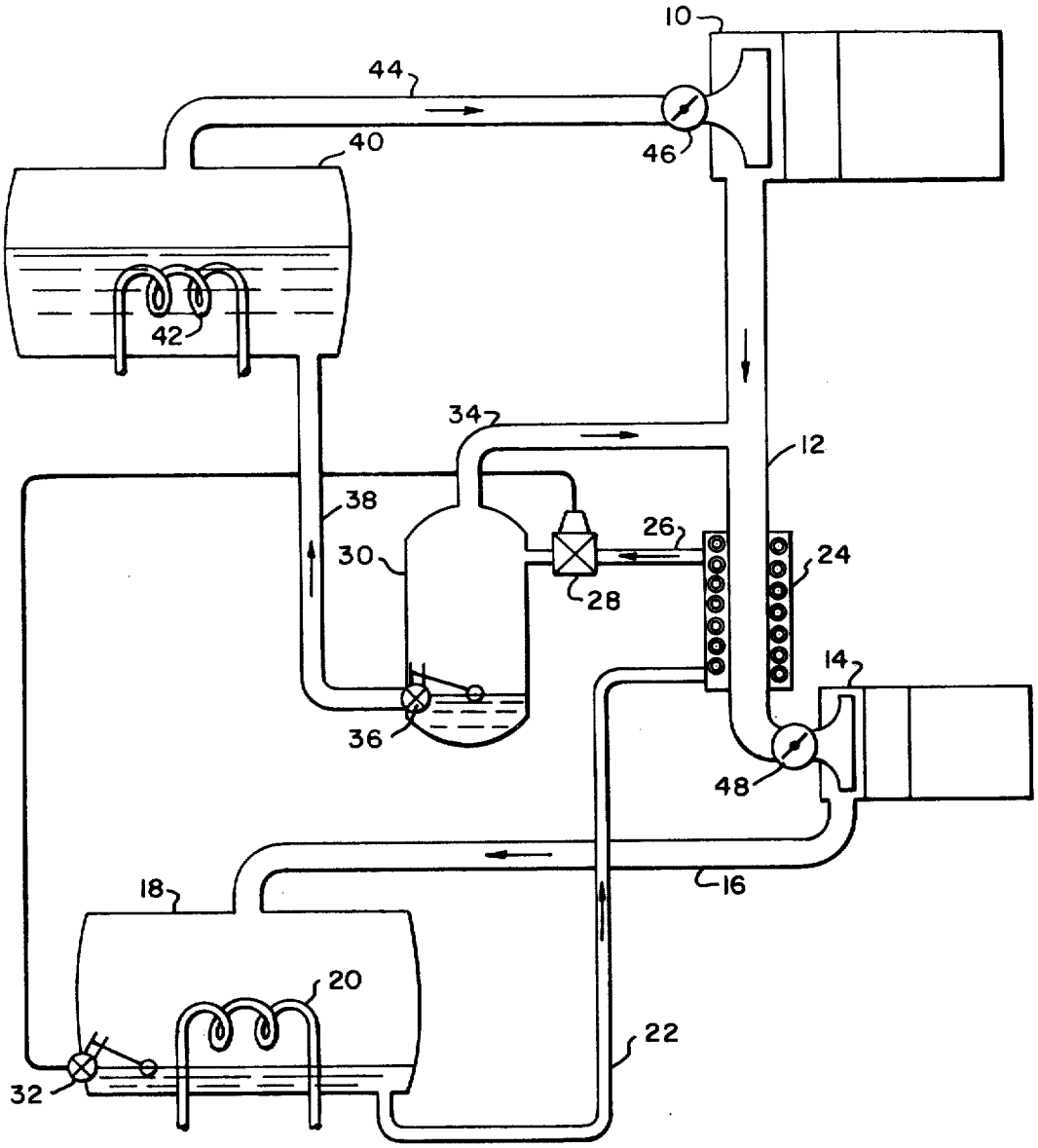
FIG. 1 is a diagrammatic view of the basic system with which the invention is concerned.

In FIG. 1, a low pressure stage centrifugal refrigerant compressor 10 has its discharge side connected through line 12 to the inlet of the high pressure stage centrifugal refrigerant compressor 14 which has its discharge side connected through line 16 to the condenser 18. Heat is absorbed from the refrigerant in the condenser by process water or steam flowing through the diagrammatically illustrated heat exchanger 20. The liquid refrigerant flows from the condenser 18 through line 22 to the liquid-to-gas heat exchanger 24 associated with the line 12 between the two stages of the compressors where the liquid refrigerant is subcooled and the vaporous refrigerant passing through line 12 is superheated.

The subcooled liquid refrigerant is passed through line 26 for passage through expansion valve 28 into flash collector tank 30. Control of the pilot expansion valve 28 is exercised by the float 32 in the condenser 18. Of the liquid-gas mixture in the collector tank 30, the vapor is fed back through line 34 to line 12 between the compressors and flows to the inlet of the high pressure compressor 14. The liquid part of the mixture is expanded through the float operated expansion valve 36 into line 38 and to the evaporator 40.

In the evaporator, the liquid-gas mixture absorbs heat from the water heat source flowing through heat exchanger 42 and the refrigerant vapor from the evaporator is drawn through line 44 back to the inlet of the low pressure compressor.

Compressor capacity control is exerted by the inlet guide vanes 46 and 48 for the low pressure and high pressure compressors, respectively. In one exemplary embodiment using R-114 refrigerant, the low pressure compressor is controlled to maintain about 50 to 60 pounds per square inch ($345 \times 10^{-3}$ to $413 \times 10^{-3}$ MPa) gauge interstage pressure and the high pressure compressor is controlled to maintain about 140 to 150 pounds per square inch ($965 \times 10^{-3}$ to $1034 \times 10^{-3}$ MPa) gauge pressure in the condenser, and with the following heat source and sink. The heat exchanger 42 associated with the evaporator receives water at, say, 77° F. (25° C.), the evaporator operates at about 68° F. (20° C.) and the exiting water is cooled to, say, 72° F. (22° C.). The condenser 18 operates at about 190° F. and heats water incoming through the heat exchanger 20 at about 176° F. (80° C.) to about 185° F. (85° C.). The interstage flash collector 30 operates at about 125° F. (52° C.).

One application in which the system of FIG. 1 is found to be useful is in taking heat from water in heat exchanger 42 used to cool plant apparatus and the like, adding to it the heat derived from the operation of the series staged compressors, and then passing the heat from the condenser 18 into water in the heat exchanger 20. The high temperature water thus obtained is circulated to the process where it is required.

It is noted that the illustrated system in FIG. 1 is not complete in the sense that there are numerous additional components, not directly having to do with the refrigeration cycle, but which are interconnected therewith and are useful in connection with the operation of the compressors. Such additional components are not shown and may include such things as an oil pump/reservoir, oil coolers, motor coolant subcoolers and gearbox vent oil separators. In an actual operating system these elements may be interconnected with each other, and with the evaporator 40, the suction line 44, the flash tank 30, and the compressor motor housings.

Figure 2:
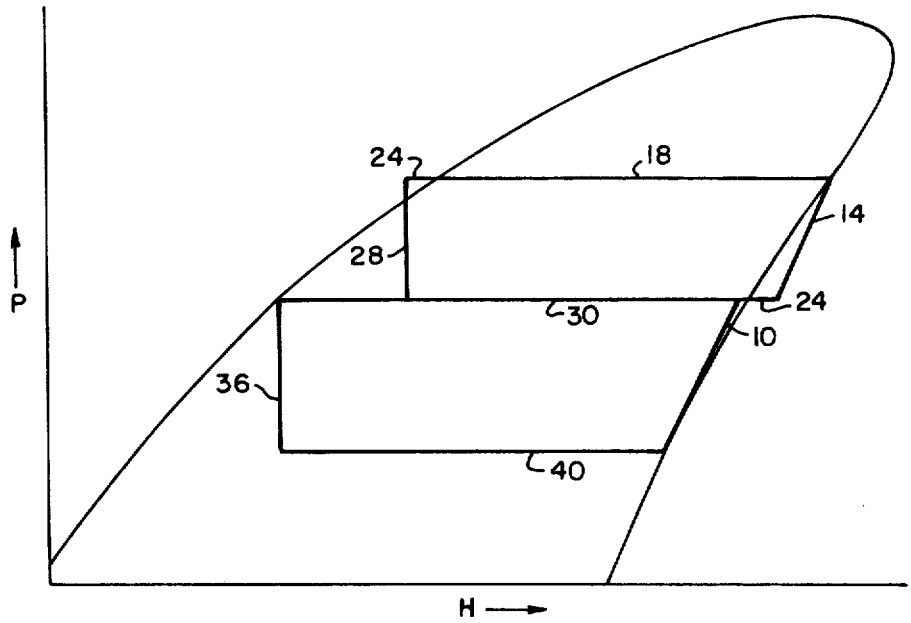
FIG. 2 is a pressure-enthalpy diagram illustrating the basic two-stage compression cycle for R-114 refrigerant.

For a further understanding of the part that the elements of FIG. 1 play in the refrigeration cycle, a pressure-enthalpy chart is shown in FIG. 2 in which each of the chart lines has a numerical designation which corresponds with the part in FIG. 1 carrying out the particular process on the chart.

Figure 3:
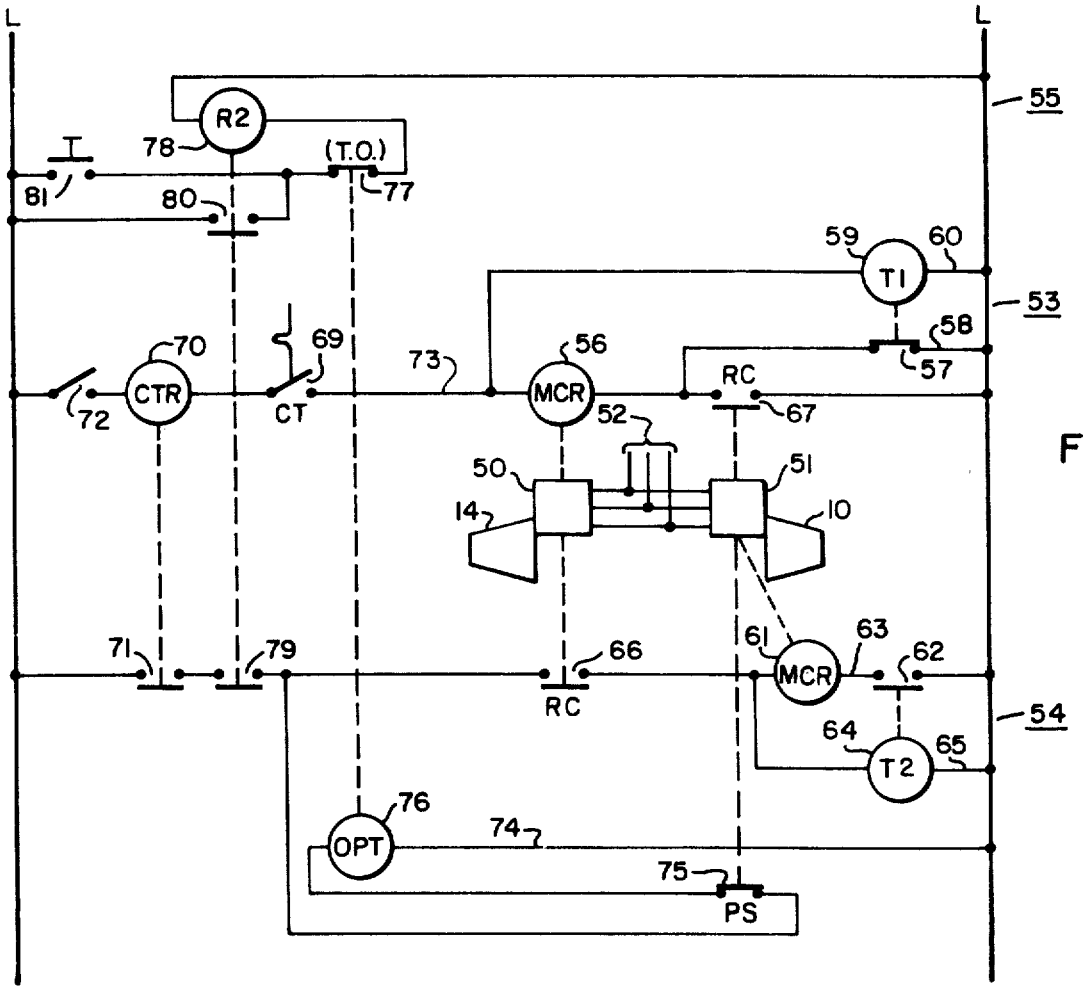
FIG. 3 is a mostly schematic view of that part of the control circuitry with which the invention is directly concerned.

Referring to FIG. 3, the high pressure compressor 14 and low pressure compressor 10 are diagrammatically illustrated with starter boxes 50 and 51 to which a three phase power line 52 is connected. In the following description the high pressure compressor 14 will be referred to as the first compressor since it is the first to be started in the system disclosed and the low pressure compressor 10 will thus be referred to as the second compressor. The reason for starting the high pressure compressor first in the particular system to be described is that it is slightly smaller than the second compressor and accordingly can be brought up to speed slightly more quickly than the other compressor. As noted before, since the compressors are started with across-the-line starters it is not desirable to start them both at exactly the same time. However, the system is of the character that neither compressor is permitted to operate alone over any significant time period since they are in series relation with respect to refrigerant flow, even though interstage expansion is present. If the low pressure compressor were to run alone, it would shutdown in response to an unduly low suction pressure in the evaporator through controls not shown. If the high pressure compressor were to run alone, surging with concomitant vibration and possible damage to the impeller could be expected.

In FIG. 3 the control line voltage is taken off a transformer (not shown) connected to the lines L. The first circuit, which directly controls the initial energization of the first refrigerant compressor 14 is designated 53 at the right of the schematic and the second circuit directly controlling the second refrigerant compressor 10 is designated 54. A third, parallel, manual reset circuit at the top of the schematic is generally designated 55.

The motor starter 50 for the first compressor 14 is pulled in when the main control relay 56 in the first circuit is energized. The first circuit includes a normally-closed, time-controlled first switch 57 in the one branch 58, this switch being operated to an open position after a first predetermined time period, such as 7 seconds, following the energization of the timing means 59 in a parallel branch 60.

The second circuit 54 includes a main control relay 61 which, upon its energization, causes the motor starter 51 to pull in to start the second compressor 10. A normally-open, time-controlled second switch 62 is in series with the control relay 61 in line 63 and operates to a closed position in a second predetermined time period, shorter in duration than the time cycle of the timer 59 in the first circuit, following energization of the second timing means 64 controlling the switch 62 and located in a parallel line 65.

The second circuit 54 also includes a third, normally-open switch 66 which is in series with the two branch lines 63 and 65 in the second circuit, and which closes in response to the operation of the motor starter 50 for the first compressor 14 closing.

A fourth, normally-open switch 67 in line 68 in the first circuit is similarly responsive and closes in response to the motor starter 51 for the second compressor 10 closing.

The remainder of the first circuit includes a cycling thermostat switch 69 responsive to changes in the condenser temperature, a relay 70 conveniently termed a cycling thermostat relay having its coil in the first circuit and the normally-open actuated switch part 71 in the second circuit, and a manually operated ON-OFF switch 72, these three elements being in a line 73 in series with the branch lines of the first circuit 53.

In the second circuit, a branch line 74 includes a fifth, normally-closed switch 75 which is mechanically linked to the motor starter 51 for the second compressor, the switch 75 operating to an open position in response to the motor starter 51 being pulled in. In series with the switch 75 in branch 74 is a third timing means 76 which provides a safety function during the starting operation by effecting the opening of its controlled, normally-closed switch 77 in the manual reset circuit 55, in the event that an improper starting condition prevails for a third predetermined time period well in excess of the other two predetermined time periods of the timers 59 and 64.

The manual-reset circuit 55 also includes, in series with the time-opened switch 77, a holding coil 78 for the normally-open relay switch 79 in the second circuit, and for the normally-open relay switch 80 in the manual-reset circuit in parallel with the momentary-contact manual switch 81.

It is noted that in addition to the components illustrated in FIG. 3, a total circuit for the operation of these types of compressors include a substantial number of additional relays, interlocks, pressure operated switches, signal lights, and safety and overload switches which are not included in FIG. 3 for purposes of clarity but are required in an actual commercial embodiment of a system including the invention herein.

CIRCUIT OPERATION

The manner in which the compressors are brought on line substantially together, but with the elapse of a very short time between being brought on line, will now be described. Following warm-up and other circuit operations in circuits not shown and not directly related to this invention, the ON-OFF switch 72 in the first circuit will be closed, and the manual-reset circuit 55 will be in a completed condition from the closure of the manual-reset switch 81, thereby energizing the holding coil 78 and resulting in the closure of switch 80 in the reset circuit and switch 79 in the second circuit. When the cycling thermostat switch 69 closes, the first circuit is in a completed condition in one branch through the control relay 56 and the closed first switch 57, and in another branch through the first timer 59 in line 60. Upon the completion of the first circuit, the energization of the cycling thermostat relay 70 causes the closure of the control switch 71 in the second circuit. With the main control relay 56 energized, the motor starter 50 is pulled in for the first compressor and the first compressor comes up to speed rapidly, such as in 2 to 3 seconds.

When the motor starter 50 is pulled in the switch 66 in the upper branch of the second circuit closes in response thereto. Thus at this time, the second circuit is in a completed condition through switch 71, switch 79 (from holding coil 78 in the manual-reset circuit 55), the switch 66 and the branch 65 in parallel with the main control relay 61 and the series connected time closed switch 62. Thus the solid state timer 64 is energized and about 5 seconds after its energization it closes switch 62, which in turn permits the energization of the main control relay 61 causing the motor starter 51 for the second compressor 10 to be pulled in. In other words, from the time that the motor starter 50 for the first compressor 14 is pulled in until the time that the motor starter 51 is pulled in by the energization of the second control relay is about 5 seconds.

When the motor starter 51 for the second compressor 10 is pulled in, this results in the closure of the starter responsive switch 67 in line 68 in series with the first control relay 56. Thus when the time-opened switch 57 through which the initial energization of the control relay 56 occurred is opened by the expiration of about 7 seconds of the first timing means 59, the control relay 56 remains energized through the closed switch 67.

It will thus be appreciated that the second compressor 10 cannot be started unless the first compressor 14 has been started first. This is because the control relay 61 for the second compressor can only be energized if the switch 66 responsive to the motor starter 50 for the first compressor is closed.

It is also important that the first compressor 14 not continue to run if the second compressor 10 has not also come on line. Thus, if the switch 67 responsive to the second compressor motor starter 51 has not operated to a closed position within the first predetermined time period following energization of the first circuit and its included timing means 59, the opening of the time-controlled switch 57 will open tha part of the first circuit including the control relay 56, thereby deenergizing that control relay and opening the power circuit through the motor starter 50. Thus the first and second circuits are electrically interconnected in the manner described to make the initial completion of the second circuit dependent upon the initial completion of the first circuit and the maintained completion of both circuits depend upon the maintained completion of the other of the circuits.

Upon the opening of the cycling thermostat switch 69, both circuits are opened and the time control switches and motor starter responsive switches assume the positions shown in FIG. 3 for a subsequent startup in the manner previously described.

During a period of normal cycling operation in accordance with the temperature demands controlling the energization of the compressors by the opening and closing of the cycling thermostat switch 69, the manual-reset circuit 55 remains completed. The time-opened safety switch 77 remains completed because when the motor starter 51 for the second compressor is pulled in about 5 seconds after the initial energization of the first circuit, that operation of the motor starter results in the opening of the controlled switch 75 in series with the safety timer 76. As noted before, since the safety timer 76 has a cycle time of continuous energization of about 1 minute before it will effect the opening of its control switch 77 in the manual-reset circuit, the early opening of the switch 75 precludes the energization of the safety timer for such an extended time. It is noted that among the additional circuitry and circuit components not shown for purposes of simplification, are certain safety devices which will prevent the control relay 61 in the second circuit from operating. If any of these conditions exist so that the control relay 61 cannot cause the motor starter 51 to pull in during a starting operation of the compressors, the switch 75 will remain closed and the safety timer 76 will time out the switch 77 in the manual-reset circuit causing it to open and deenergize the holding coil 78, thereby resulting in opening of switches 79 in the second circuit and 80 in the manual reset circuit. For any subsequent restarting of the compressor after the problem causing the difficulty has been resolved, it will be necessary for the manually-operated switch 81 to be momentarily closed. It is the inclusion of the switch 71 which functions as a slave to the cycling thermostat switch 69 which avoids the problem of the manual-reset circuit 55 being deenergized each time the cycling thermostat switch 69 opens.

We claim:

1. A heat pump system comprising:
   - a first and a second refrigerant compressor arranged for series refrigerant flow;
   - a pair of parallel control circuits;
   - the first of said circuits including a first main control relay required to be energized to start said first compressor, and the second of said circuits including a second main control relay required to be energized to start said second compressor;
   - means electrically interconnecting said circuits to make the energization of said second control relay dependent upon the energization first of said first control relay and the elapse of a short time period following the energization of said first control relay, and to make the continued energization of said first control relay beyond a time period slightly longer than said short time period following initial energization of said first control relay dependent upon the energization of said second control relay before the elapse of said slightly longer time period.

2. A heat pump system according to claim 1 wherein:

said electrically interconnecting means includes in each of said circuits timing means and switch means operated thereby for obtaining said predetermined time periods.

3. A system according to claim 2 including:

a motor starter for each of said compressors and operated to a closed position by energization of its respective control relay; and said electrically interconnecting means includes normally-open switch means in each of said circuits operable to a closed position in response to operation of the respectively opposite motor starter to its closed position.

4. A system according to claim 3 including:

thermostatically-controlled switch means in the first of said circuits having a normally-open position and operable to a closed position in response to a demand for operation of said heat pump system; and slave switch means in said second circuit controlled in response to energization of means in said first circuit so that said slave switch means operates concurrently with said thermostatic switch means.

5. A heat pump system comprising:

a first and a second refrigerant compressor arranged in series relation;

control circuit means for controlling the operation of said compressors comprising a first circuit and a second parallel circuit;

said first circuit including a first control relay required to be energized to initially energize said first compressor and, in series therewith, normally-closed first switch means operable to an open position after a first predetermined time following initial energization of said first control relay;

said second circuit including a second control relay required to be energized to initially energize said second compressor and, in series therewith, normally-open second switch means operable to a closed position after a second predetermined time, shorter in duration than said first predetermined time, following initial energization of said second circuit;

third normally-open switch means in said second circuit in series with said second control relay and operable to a closed position in response to said first compressor being energized, so that energization of said second compressor is precluded if said first compressor is not first energized; and fourth normally-open switch means in said first circuit, in series with said first control relay and in parallel with said first switch means, and operable to a closed position in response to said second compressor being energized, so that continued energization of said first compressor beyond said second predetermined time period is precluded if said second compressor is not energized.

6. A system according to claim 5 including:

first timer means in said first circuit in parallel with said first control relay for operating said first switch; and second timer means in said second circuit in parallel with said second control relay for operating said second switch.

7. A system according to claim 5 including:

thermostatically-controlled switch means in said first circuit for controlling, under normal operation, the energization of said first circuit in accordance with temperature demands; and relay means including an actuating part in said first circuit in series with said thermostatically-controlled switch means, and a normally-open switch in said second circuit actuated to a closed position in response to current flow through said actuating part so that said control of said second circuit and said first circuit is concurrent with respect to operation in accordance with temperature demands.

8. A system according to claim 7 including:

a third parallel, manual-reset, circuit required to be maintained in a completed condition to permit the energization of said first and second circuits under normal operating condition;

a branch circuit in said second circuit, in series with said relay switch in said second circuit, said branch circuit including third timing means for effecting opening of said manual-reset circuit after a predetermined single period of energization of said branch circuit in excess of said other predetermined periods, and fifth normally-closed switch means in said branch circuit operable to an open position when said second compressor is energized, said fifth switch means preventing continued energization of said third timing means when said second compressor is energized, and, said relay switch means in said second circuit preventing the continued energization of said branch circuit during those periods when said second compressor is not energized because of the lack of demand for operation due to temperature conditions.

* * * * *